United States Patent [19]

Hirano

[11] Patent Number: 4,722,304

[45] Date of Patent: Feb. 2, 1988

[54] COOLING SYSTEM FOR AUTOMOTIVE ENGINE OR THE LIKE

[75] Inventor: Yoshinori Hirano, Yokohama, Japan

[73] Assignee: Nissan Motor Co., Ltd., Yokohama, Japan

[21] Appl. No.: 948,072

[22] Filed: Dec. 31, 1986

[30] Foreign Application Priority Data

Jan. 10, 1986 [JP] Japan ..... 61-3011

[51] Int. Cl.[4] ..... F01P 3/22

[52] U.S. Cl. ..... 123/41.21; 123/41.27

[58] Field of Search ..... 123/41.2–41.27

[56] References Cited

U.S. PATENT DOCUMENTS

| | | | |
|---|---|---|---|
| 1,226,180 | 5/1917 | Bouton, Jr. | 123/41.2 |
| 1,671,440 | 5/1928 | Muir | 123/41.25 |
| 1,709,863 | 4/1929 | Modine | 123/41.26 |
| 2,083,611 | 6/1937 | Marshall | 62/125 |
| 2,292,946 | 8/1942 | Karig | 123/174 |
| 2,403,218 | 7/1946 | Hanners | 123/41.26 |
| 2,449,110 | 9/1948 | Eells | 123/41.26 |
| 2,844,129 | 7/1958 | Beck, Jr. et al. | 123/41.21 |
| 3,082,753 | 3/1963 | Bullard | 123/41.24 |
| 3,168,080 | 2/1965 | Latterner et al. | 123/41.26 |
| 4,538,554 | 9/1985 | Hayashi | 123/41.21 |
| 4,550,694 | 11/1985 | Evans | 123/41.27 |
| 4,630,572 | 12/1986 | Evans | 123/41.21 |
| 4,632,069 | 12/1986 | Aoki et al. | 123/41.15 |

*Primary Examiner*—William A. Cuchlinski, Jr.

*Attorney, Agent, or Firm*—Schwartz, Jeffery, Schwaab, Mack, Blumenthal & Evans

[57] ABSTRACT

In order to avoid the need to expose a coolant level control pump to hot and/or near boiling condensate the radiator is disposed at a level higher than the coolant jacket and gravity is used to return the condensate to the coolant jacket. A level sensor in the coolant jacket senses the coolant level and energizes the pump to induct cool coolant from a reservoir in the event that the level is found inadequate. The cooling circuit can be vented to the atmosphere in order to drop the excess coolant which is introduced into the system during non-use periods to the required level to speed engine warm-up following a cold engine start.

14 Claims, 7 Drawing Figures

COOLING SYSTEM FOR AUTOMOTIVE ENGINE OR THE LIKE

BACKGROUND OF THE INVENTION

1. Field of the Invention

The present invention relates generally to an evaporative type cooling system for an internal combustion engine wherein liquid coolant is permitted to boil and the vapor used as a vehicle for removing heat therefrom, and more specifically to such a system which does not require a plurality of electromagnetic valves and a complex control circuit to achieve the required coolant management and which avoids exposing a coolant level control pump included in the system to hot and/or near boiling condensate.

2. Description of the Prior Art

In currently used "water cooled" internal combustion engines (liquid) is forcefully circulated by a water pump, through a cooling circuit including the engine coolant jacket and an air-cooled radiator. This type of system encounters the drawback that a large volume of water is required to be rapidly circulated between the radiator and the coolant jacket in order to remove the required amount of heat.

Further, due to the large mass of water inherently required, the warm-up characteristics of the engine are undesirably sluggish. For example, if the temperature difference between the inlet and discharge ports of the coolant jacket is 4 degrees, the amount of heat which 1 Kg of water may effectively remove from the engine under such conditions is 4 Kcal. Accordingly, in the case of an engine having an 1800 cc displacement (by way of example) is operated full throttle, the cooling system is required to remove approximately 4000 Kcal/h. In order to achieve this, a flow rate of approximately 167 liter/min must be produced by the water pump. This of course undesirably places a load on the engine which increases engine fuel consumption and reduces the amount net power produced.

FIG. 2 shows an arrangement disclosed in Japanese Patent Application Second Provisional Publication Sho. 57-57608. This arrangement has attempted to vaporize a liquid coolant and use the gaseous form thereof as a vehicle for removing heat from the engine. In this system the radiator 1 and the coolant jacket 2 are in constant and free communication via conduits 3, 4 whereby the coolant which condenses in the radiator 1 is returned to the coolant jacket 2 little by little under the influence of gravity. This arrangement while eliminating the power consuming coolant circulation pump which plagues the above mentioned arrangement, has suffered from the drawbacks that the radiator, depending on its position with respect to the engine proper, tends to be at least partially filled with liquid coolant. This greatly reduces the surface area via which the gaseous coolant (for example steam) can effectively release its latent heat of vaporization and accordingly condense, and thus has lacked any notable improvement in cooling efficiency. Further, with this system in order to maintain the pressure within the coolant jacket and radiator at atmospheric, a gas permeable water shedding filter 5 is arranged as shown, to permit the entry of air into and out of the system.

However, this filter permits gaseous coolant to escape from the system, inducing the need to frequently add fresh coolant. A further problem with this arrangement has come in that some of the air, which is sucked into the cooling system as the engine cools, tends to dissolve in the water, whereby upon start up of the engine, the dissolved air tends to come out of solution and forms small bubbles in the radiator which adhere to the walls thereof and form an insulating layer. The undissolved air also tends to collect in the upper section of the radiator and inhibit the convention-like circulation of the vapor from the cylinder block to the radiator. This of course further deteriorates the performance of the device. During non-use the upper sections of the cooling system are exposed to atmospheric air and are thus prone to rapidly rust or undergo the like type of deterioration.

European Patent Application Provisional Publication No. 0 059 423 published on Sept. 8, 1982 discloses another arrangement wherein, liquid coolant in the coolant jacket of the engine, is not forcefully circulated therein and permitted to absorb heat to the point of boiling. The gaseous coolant thus generated is adiabatically compressed in a compressor so as to raise the temperature and pressure thereof and thereafter introduced into a heat exchanger (radiator). After condensing, the coolant is temporarily stored in a reservoir and recycled back into the coolant jacket via a flow control valve.

This arrangement has suffered from the drawback that when the engine is stopped and cools down the coolant vapor condenses and induces sub-atmospheric conditions which tend to induce air to leak into the system. This air tends to be forced by the compressor along with the gaseous coolant into the radiator.

Due to the difference in specific gravity, the above mentioned air tends to rise in the hot environment while the coolant which has condensed moves downwardly. The air, due to this inherent tendency to rise, tends to form pockets of air which cause a kind of "embolism" in the radiator and which badly impair the heat exchange ability thereof. With this arrangement the provision of the compressor renders the control of the pressure prevailing in the cooling circuit for the purpose of varying the coolant boiling point with load and/or engine speed difficult.

FIG. 3 shows an evaporative cooling arrangement disclosed in U.S. Pat. No. 4,367,699 issued on Jan. 11, 1983 in the name of Evans wherein the coolant is boiled and the vapor used to remove heat from the engine. This arrangement features a separation tank 6 wherein gaseous and liquid coolant are initially separated. The liquid coolant is fed back to the cylinder block 7 under the influence of gravity while the relatively dry gaseous coolant (steam for example) is condensed in a fan cooled radiator 8.

The temperature of the radiator is controlled by selective energizations of the fan 9 which maintains a rate of condensation therein sufficient to provide a liquid seal at the bottom of the device. Condensate discharged from the radiator via the above mentioned liquid seal is collected in a small reservoir-like arrangement 10 and pumped back up to the separation tank via a small constantly energized pump 11.

This arrangement, while providing an arrangement via which air can be initially purged to some degree from the system tends to, due to the nature of the arrangement which permits said initial non-condensible matter to be forced out of the system, suffers from rapid loss of coolant when operated at relatively high altitudes. Further, once the engine cools air is relatively freely admitted back into the system particularly into the condensor or radiator. As a large surface of the interior of the system is exposed to atmospheric oxygen during non-use the system tends to deteriorate (rust) rapidly. The need for a relatively large separation tank complicates engine layout in cramped automotive engine compartments.

FIG. 4 of the drawings shows an engine system disclosed in Japanese Patent Application First Provisional Publication No. Sho. 56-32026 wherein the structure defining the cylinder head and cylinder liners are covered with a porous layer of ceramic material 12 and wherein coolant is sprayed into the cylinder block from shower-like arrangements 13 located above the cylinder heads 14. The interior of the coolant jacket defined within the engine proper is essentially filled with gaseous coolant during engine operation.

However, this arrangement has proven totally unsatisfactory in that upon boiling of the liquid coolant absorbed into the ceramic layers, the vapor thus produced and which escapes toward and into the coolant jacket, inhibits the penetration of fresh liquid coolant into the layers. This induces the situation wherein rapid overheat and permanent thermal damage of the ceramic layers 12 and/or engine soon results.

FIG. 5 shows an evaporative cooling system disclosed in U.S. Pat. No. 2,844,129 published on July 22, 1958 in the name of Beck et al. In this system the radiator or condensor 20 is disposed above the engine proper and arranged so that the coolant vapor generated in the engine coolant jacket can rise thereinto and be subsequently condensed. Some of the condensate formed in the condensor is returned directly to the engine coolant jacket 26 while the remainder is circulated through a heat exhanger disposed 22 in the sump 24 of the engine. This permits the oil of the engine to warm more rapidly than normal and assists engine warm-up in cold environments. In the event that temperature of the oil exceeds that of the coolant flowing through the heat exchanger a cooling effect is produced. Viz., by the very nature of the system the amount of coolant which is circulated through the heat exchanger is quite small and therefor tends to boil in the event that the oil in the sump contains a large amount of heat. This produces the undesirable effect that the coolant vapor, which under such conditions bubbles into the coolant in the coolant jacket, can induce the formation of large cavitations or pockets of coolant vapor which invite the subsequent formation of localized "hot spots" and thermal damage. The boiling action also inhibits the introduction of fresh coolant into the heat exchanger 22 and thus reduces the efficiency of the device.

During periods of non-use contaminating air tends to leak into the radiator and induce the rusting and heat exchange efficiency problems discussed hereinbefore.

Japanese Patent Application Second Provisional Publication No. 47-5019 discloses an arrangement is such that when the coolant in the coolant jacket heats and expands, the excess coolant is displaced from the top of the radiator to a reservoir by way of a discharge conduit. This conduit extends deep into the reservoir and terminates close to the bottom thereof. With this arrangement when coolant vapor is discharge from the radiator it bubbles through the liquid coolant in the reservoir and condenses. A cooling fan is arranged to induce a cooling draft of air to pass over the finned tubing of the radiator and induce coolant vapor to condense. Depending on the ambient temperature and the amount of heat being produced by the engine the level of liquid coolant reduces under the boiling action until an equilibium level is established.

When the engine stops and cools, coolant from the reservoir is re-inducted to fill the radiator 16 and coolant jacket. The chamber which is fluidly communicated with the bottom of the reservoir acts as a gas spring.

However, with this arrangement as the system is hermetically closed control of the boiling point of the coolant using only the fan is extremely difficult. further, the non-immersed components of the system apt to undergo rusting during non-use.

FIG. 6 shows an arrangement which is disclosed in U.S. Pat. No. 4,549,505 issued on Oct. 29, 1985 in the name of Hirano. The disclosure of this application is hereby incorporated by reference thereto. For convenience the same numerals as used in the above mentioned Patent are also used in FIG. 6.

This arrangement while solving many of the drawbacks encountered with the previously discussed prior art and providing very acceptable performance characteritics has suffered from the drawbacks that a plurality of electromagnetic valves and conduits are required to enable the desired temperature and coolant control. This adds to the cost and complexity of the system as well as increasing the crowding of the engine compartment when used in conjunction with an automotive engine. Further, the electrically operated pump which returns condensate from the condensor or radiator of the system to the coolant jacket, is very frequently exposed to hot and/or near boiling condensate. This requires a relatively expensive and robust construction which further adds to the cost of the system.

SUMMARY OF THE INVENTION

It is an object of the present invention to provide an evaporative cooling system for an automotive engine or the like, which system is relatively simple in that it requires only one electromagnetic valve for its operation, can obivate the internal rusting problems due to prolonged exposure to large amounts of atmospheric oxygen and which also avoids exposing a pump which is associated with the cooling system to hot coolant condensate.

In brief, the above object is achieved by an arrangement wherein the radiator in which the coolant vapor is condensed is disposed at a level higher than the coolant jacket and gravity is used to return the condensate to the coolant jacket. A level sensor in the coolant jacket senses the coolant level and energizes a pump to induct cool coolant from a reservoir in the event that the level is found inadequate. The cooling circuit can be vented to the atmosphere in order to drop the excess coolant which is introduced into the system during non-use periods to the required level to speed engine warm-up following a cold engine start.

More specifically, a first aspect of the present invention comes in a cooling system for an engine having a structure subject to a high heat flux which comprises: a coolant jacket disposed about the structure, the coolant jacket being adapted to receive coolant in liquid form, permit the same to boil and discharge it in gasesous form; a radiator in fluid communication with the coolant jacket through a connection structure, the radiator being disposed at a level higher than the coolant jacket so that vapor condensed therein can flow under the influence of gravity back to the coolant jacket, the coolant jacket, the radiator and the connection structure fluidly interconnecting the same defining a closed loop cooling circuit; a device associated with the radiator for varying the amount of heat exchange between the radiator and a cooling medium surrounding the same; a first temperature sensor disposed in the radiator, the first temperature sensor being operatively connected with the device in a manner to promote the amount of heat exchange between the radiator and the medium in the event that temperature proximate the first temperature sensor reaches or exceeds a first predetermined temperature; a reservoir which is fluidly discrete from the cooling circuit and in which liquid coolant is stored; a level control conduit fluidly interconnecting the reservoir and the coolant jacket; a pump disposed in the level control conduit; and a level sensor disposed in the coolant jacket, the level sensor being arranged to sense the level of liquid coolant falling below a predetermined level which is selected to immerse the structure in a predetermined depth of coolant and define a coolant vapor collection space thereabove, the level sensor being operatively connected with the pump for inducing the pump to induct coolant from the reservoir and pump same into the coolant jacket upon the level of liquid coolant in the coolant jacket falling below the predetermined level.

A second aspect of the invention comes in the form of a method of cooling an engine having a structure subject to high heat flux comprising the steps of: introducing liquid coolant into a coolant jacket disposed about the structure, permitting the liquid coolant to boil and produce coolant vapor; condensing the coolant vapor in a radiator in fluid communication with the coolant jacket; using gravity to return the condensate formed in the radiator to the coolant jacket; storing coolant in a reservoir which is fluidly discrete from the coolant jacket and the radiator; sensing the level of coolant in the coolant jacket; and pumping coolant from the reservoir into the coolant jacket in response to the step of level sensing indicating that the level of liquid coolant in the coolant jacket is below a predetermined level which is selected to immerse the structure in a predetermined depth of liquid coolant and define a coolant collection space.

IDETAILED DESCRIPTION OF THE PREFERRED EMBODIMENTS

Figure 7:
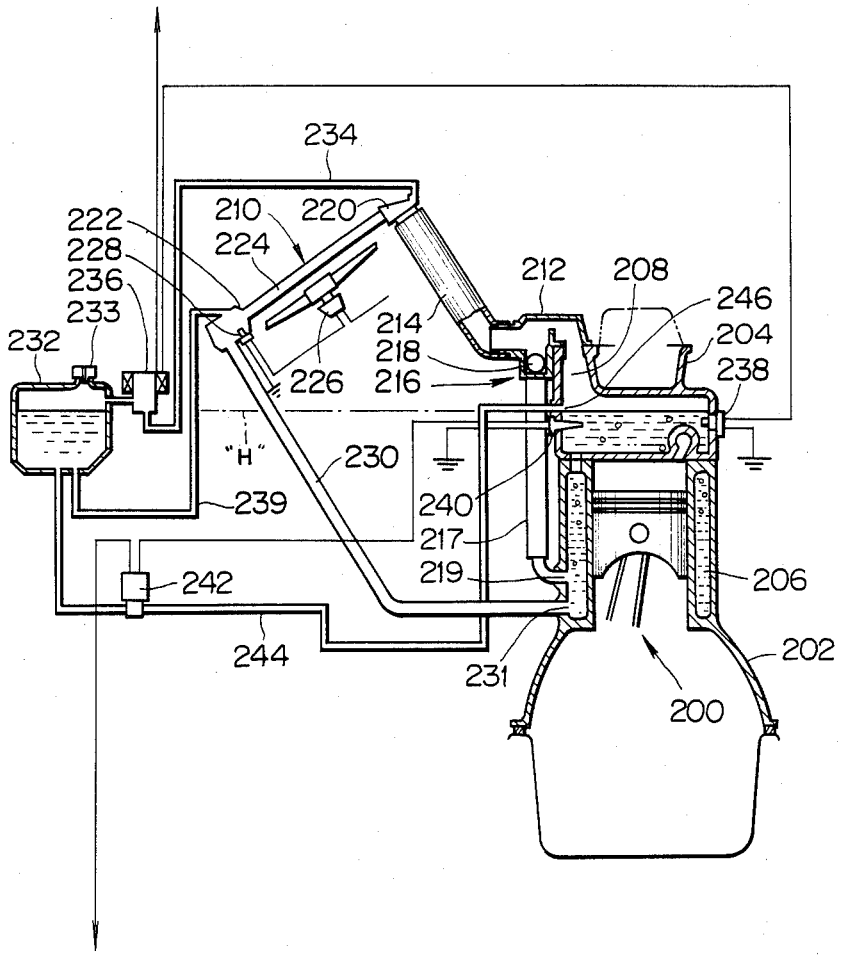
FIG. 7 shows an evaporative cooling system which embodies the present invention.

FIG. 7 of the drawings shows an engine system to which a first embodiment of the invention is applied. In this arrangement an internal combustion engine 200 includes a cylinder block 202 on which a cylinder head 204 is detachably secured. The cylinder head and block are formed with suitably cavities which define a coolant jacket 206 about structure of the engine subject to high heat flux (e.g. combustion chambers exhaust valves conduits etc.,). One or more vapor discharge ports 208 formed in the cylinder head 204 are fluidly communicated with a condensor or radiator 210 as it will be referred to hereinafter, by a vapor manifold 212 and transfer conduit 214. The vapor manifold 212 includes a vapor/liquid separator arrangement 216. A conduit 217 leads from a drain port 218 of the separator to a port 219 formed in the cylinder block 202 and returns any liquid coolant which has bumped or been otherwise forced out of the coolant jacket and/or any coolant which has condensed in the vapor transfer conduit 214 per se. Port 219 is formed at a relatively low level of the coolant jacket 206.

For further details relating to the design and arrangement of a manifold which can be used in the instant situation, reference may be had to U.S. Pat. No. 4,499,866 issued on Feb. 19, 1985 in the name of Hirano, U.S. Pat. No. 4,570,579 issued on Feb. 18, 1986 in the name of Hirano and copending U.S. patent application Ser. No. 866,259 filed on May 23, 1986 in the name of Shimonosono now U.S. Pat. No. 4,664,072. The content of these documents are hereby incorporated by reference thereto.

In this embodiment the radiator 210 is located at a level which is higher than the engine coolant jacket and inclined in a manner which permits the condensate formed therein to drain toward the lowermost section thereof under the influence of gravity. The radiator includes a upper tank 220 which fluidly communicates with the vapor transfer conduit 214, a lower tank 222 located at the downstream end of the device and a core 224 in the form of plurality of pipes which extend therebetween. This core 224 defines the major heat exchange surfaces of the radiator and is designed to have a thermal heat exchange capacity slightly greater than the maximum possible thermal requirement of the engine.

A cooling fan 226 is disposed with the radiator in a manner to induce a draft of cooling air to pass over the above mentioned heat exchanging surfaces when energized. This fan 226 is controlled by a temperature sensor 228 (a bimetal switch for example) disposed in the lower tank 222. In this embodiment the temperature sensor 228 is arranged to be triggered when the temperature in the lower tank 222 reaches and or exceeds 95° C. (by way of example). It should be noted that the selection of this value is made in view of the type of coolant being used and the altitudes at which the vehicle is expected to operate. Viz., in the case the coolant is water containing an anti-freeze such as ethylene glycol and a trace of anti-corrosive, the boiling point exceeds 100° C. (at sea level) and thus the above mentioned temperature is indicative of the radiator 210 being close to being filled with coolant vapor. However, in the event that the engine 200 is to operated at high altitudes it may be desired to set the temperature a little lower to compensate for the reduced boiling point which results under such conditions.

A coolant return conduit 230 leads from the lower tank 222 to a port 231 formed in the lower section of the coolant jacket at a level below that at which port 219 is formed.

In the above described arrangement the coolant jacket 206, vapor manifold 212, vapor transfer conduit 214, radiator 210 and coolant return conduit define a closed loop cooling circuit through which the coolant is continually cycled.

A reservoir 232 is disposed beside the engine at a level essentially as illustrated. The reason for this disposition will become clear hereinlater. The interior of the reservoir 232 is maintained constantly at atmospheric pressure via the provision of a small air bleed (no numeral) formed in the filler cap 233 hereof. This air bleed is relatively small and thus prevents any loss of coolant via splashing and the like.

The reservoir 232 communicates with the upper tank 220 through a vent conduit 234. A normally closed electromagentic valve 236 is disposed in this conduit and arranged to permit fluid communication between the upper tank and the reservoir when energized.

A temperature sensor 238 (e.g. bimetallic switch) is disposed in the engine coolant jacket 206 and circuited with the valve 236. This switch 238 is arranged to close and produce an ON signal upon when the temperature in the coolant jacket 206 is at or below a preselected level which in this case is 50° C. by way of example. Hence, when the engine is in operation and the coolant temperature is low (viz., a cold engine start) the valve 236 will be opened to establish fluid communication between the atmosphere and the interior of the cooling circuit.

The reservoir 232 also communicates with the lower tank 222 of the radiator 210 via what shall be termed a purge/transfer conduit 239. When the engine 200 is shut-down (stopped) coolant is inducted from the reservoir 232 into the cooling circuit through this conduit, while when subject to a cold start air is purged out of the circuit through the same. These functions will be dealt with in detail hereinlater.

In order to ensure that the level of liquid coolant in the coolant jacket 206 remains at or slightly above the required level, a level sensor 240 such as a float and reed type switch is disposed in the coolant jacket 206 at level which is selected to be at or just above the minimum acceptable level. Viz., a level which should be maintained in order to ensure that the highly heated structure of the engine 200 remains securely immersed in sufficient liquid coolant that despite the bumping and frothing which accompanies the vigorous boiling which occurs in the cylinder head section of the coolant jacket, while providing a vapor collection space which facilitates smooth egress of the coolant vapor toward the discharge portor ports 208. This level sensor 240 is circuited with a relatively small capacity electrically driven pump 242 disposed in what shall be termed a level control conduit 244. This conduit 244 as shown, leads from the bottom of the reservoir 232 to a level control port 246 which is located above the the level sensor 240. With this arrangement in the event that the level sensor 240 detects the level of coolant having dropped to the point at which the reed switch is triggered, coolant is inducted from the reservoir 232 and introduced into the coolant jacket 206. Due to the location of the port 246 the coolant is prevent from backflowing out of the coolant jacket 206 after the level has lowered to a level "H". This permits the use of a simple type centrifugal pump or the like.

Figure 1:
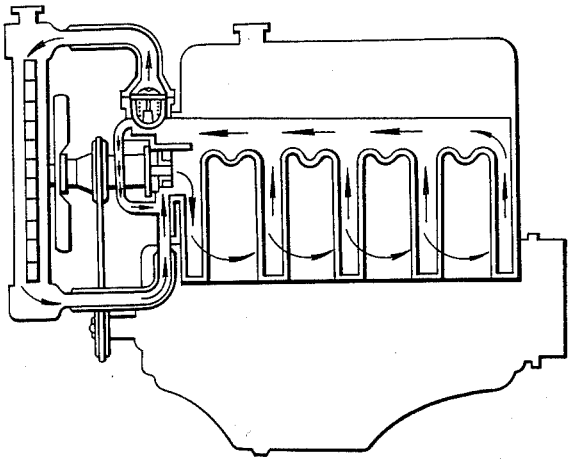
FIG. 1 (PRIOR ART)
FIGS. 1 to 6 show the prior art arrangements discussed in the opening paragraphs of the instant disclosure.
Figure 2:
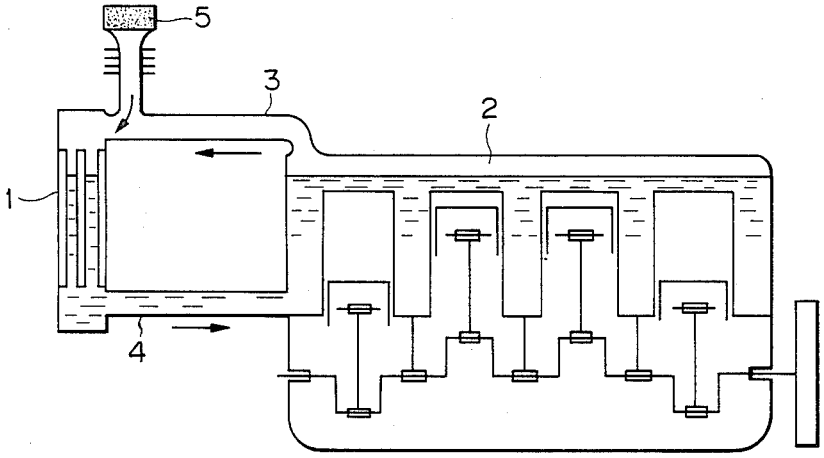
FIG. 2 (PRIOR ART)
Figure 3:
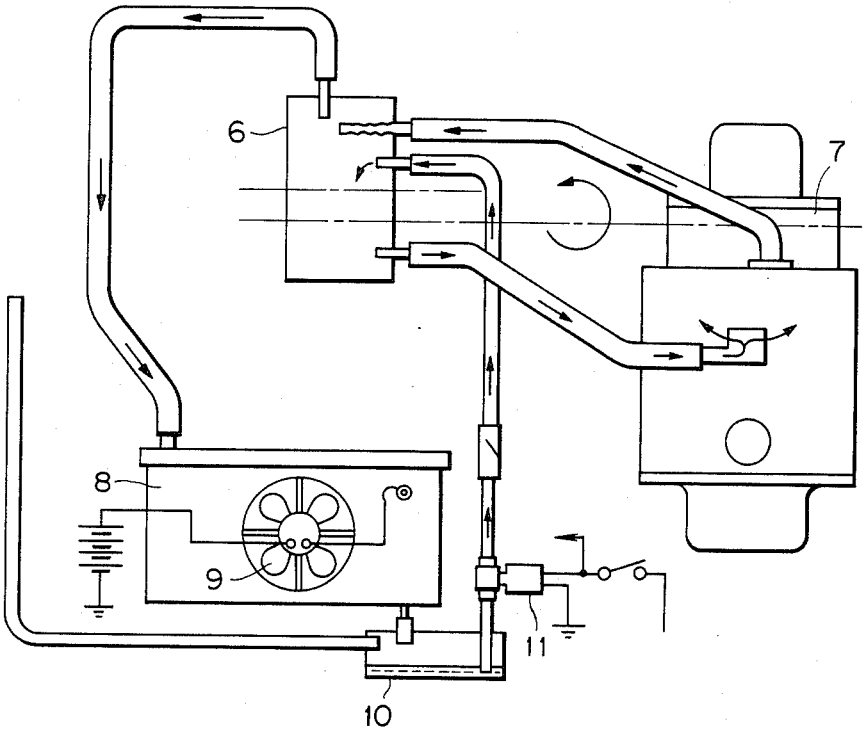
FIG. 3 (PRIOR ART)
Figure 4:
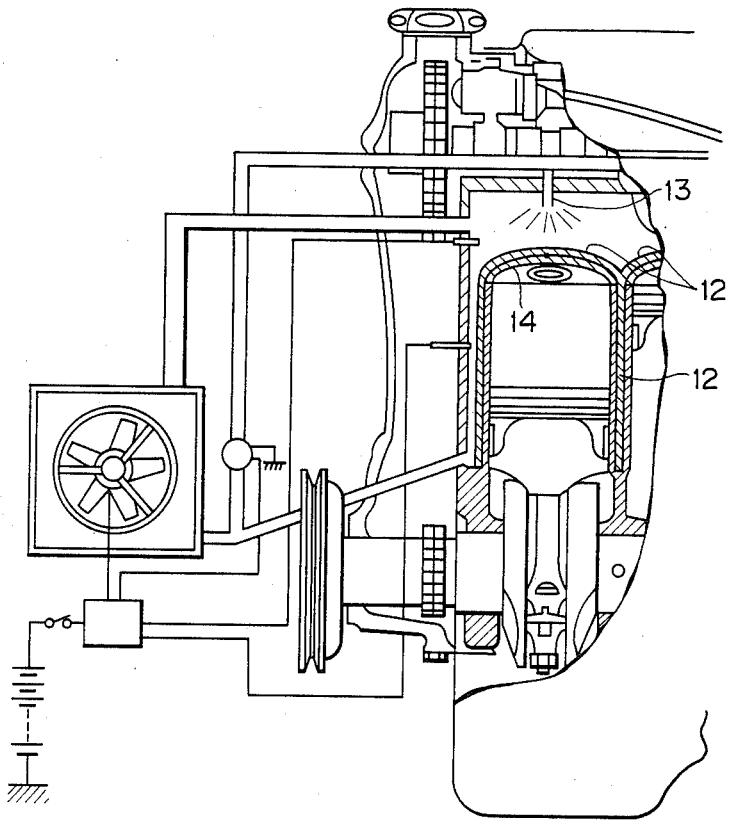
FIG.4 (PRIOR ART)
Figure 5:
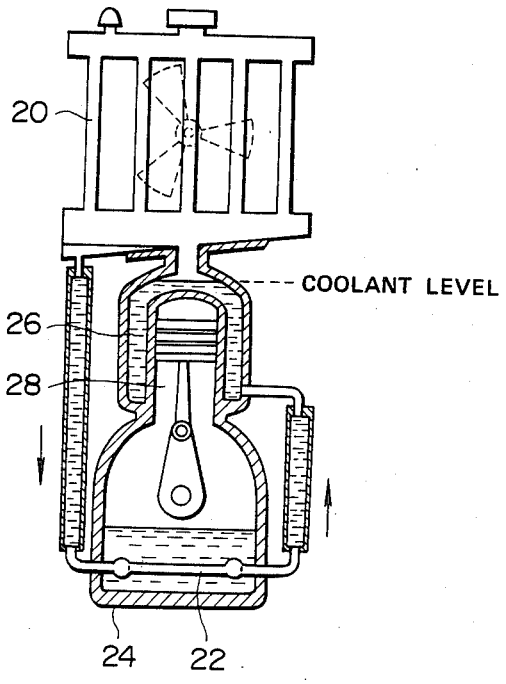
FIG.5 (PRIOR ART)
Figure 6:
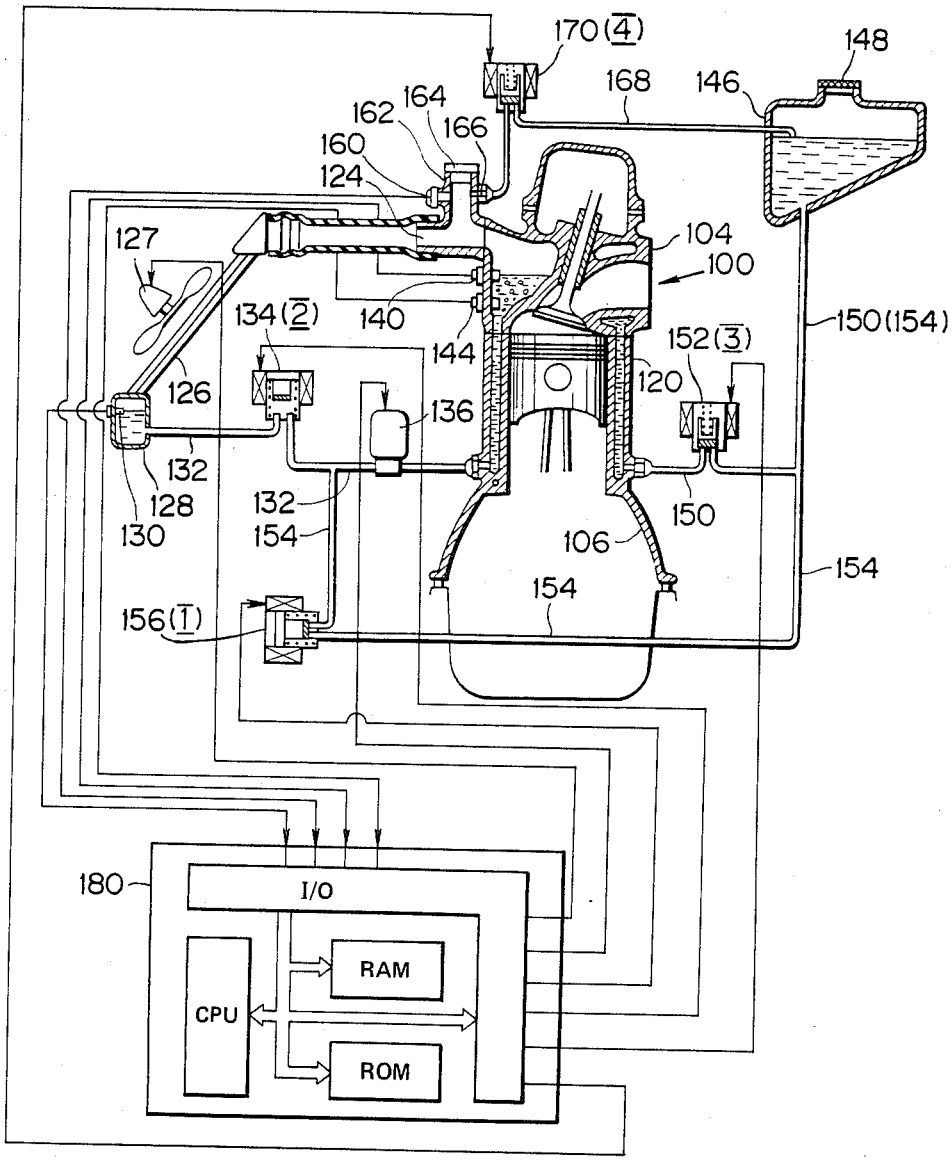
FIG.6 (PRIOR ART)

It will also be noted at this time that as the pump 242 is located in the level control conduit 244 which does not form part of the closed loop cooling circuit, the pump 242 is never exposed to highly heated coolant such as is experienced with the system shown in FIG. 6. This permits the use of an inexpensive relatively low thermal resistance "off the shelf" type pump which pumps in a single flow direction only. It is however, important that the pump 242 be of such a design that coolant may flow relatively unimpeded therethrough (particularly in the coolant jacket to reservoir direction) when it is not pumping. This requirement will become better appreciated hereinlater during the description of the "quick warm-up" feature possible with the present invention.

Prior initial operation the coolant jacket 206 and the reservoir 232 are filled with liquid coolant until levels therein are essentially a level "H". This may be done using a filler port (not shown) formed at a suitable location in the upper section of the coolant jacket or by filling the reservoir 232 and energizing pump 242 until such time as level sensor 240 indicates that the level of coolant in the coolant jacket is proximate the desired one. The size of the reservoir 232 is selected to hold a little more than the internal volume of the cooling circuit defined above level "H" and thus ensure that there is always sufficient coolant in the reservoir 232 so that when the engine 200 is not in use an adequate amount of coolant is available to completely fill the cooling circuit.

When the engine 200 is started as the coolant temperature is below 50° C. the system is supplied electrical power via the closure of the engine ignition switch or the like and electromagnetic valve 236 is energized to assume an open position. During the initial engine start this has no effect. As the coolant in the coolant jacket 206 is not circulated it quickly heats and starts producing coolant vapor. When the temperature of the coolant reaches 50° C. valve 236 is de-energized and assumes a closed position. The coolant vapor displaces the air in the upper section (vapor collection space) of the coolant jacket 206, vapor manifold 212 and transfer conduit 214 up into the upper tank 220 of the radiator 210. Subsequently, as further coolant vapor is generated, the air in the radiator 210 which is cooler than the vapor due to its inherent insulative properties is displaced down into the lower tank 222 and out to the reservoir 232 via purge/transfer conduit 239. Upon the radiator 210 becomming essentially full of coolant vapor temperature sensor 228 energizes the fan 226. This promotes an increase in the condensation rate within the radiator 210 and thus induces the situation wherein the temperature in the lower tank 222 drops and permits the fan 226 to stop. Repetition of this control maintains the appropriate rate of condensation for the instant engine load and the amount of heat emitted therefrom.

In cold environments it may be not be necessary to completely purge all of the air out of the system however, in the event that sufficient air is still retained in the radiator 210 to the degree that a loss of cooling efficiency is experienced and the required amount of heat cannot be removed despite the continued operation of the cooling fan 226, as the temperature and pressure continue to rise, the remaining air tends to be purged by a flow of vapor which passes through the purge/supply conduit 239. As this conduit communicates with the bottom or lower section of the reservoir 232 any coolant vapor which actually enters the reservoir 232 is quickly condensed via contact with the cool coolant contained therein and thus not lost from the system.

If the level sensor 240 detects the level of coolant in the coolant jacket 206 having dropped therebelow, pump 242 is energized in manner which replenishes the same. As previously noted, as gravity is used to return the hot freshly formed condensate to the coolant jacket 206, this pump 242 is very infrequently used thus ensuring good electrical power consumption economy. Moreover, it is essentially never exposed to highly heated fluids.

As the operation of the pump 242 will normally occur very infrequently, excessive operation can be taken to indicate a system malfunction wherein coolant is being lost and/or is in chronic shortage. In order to monitor this operation arrangements such as disclosed in copending U.S. patent application Ser. No. 705,928 filed on Feb. 26, 1985 in the name of Aoki et al (now in condition for allowance) may be used now U.S. Pat. No. 4,632,069. The content of this application is hereby incorporated by reference thereto.

It is within the scope of the present invention to arrange for the cooling fan 226 and temperature sensor 228 to be circuited directly with a source of electrical power and not be effected by the condition of the engine ignition switch. The reason for this is to enable the operation of the fan 226 to be continued after the engine is stopped via the opening of said switch. Viz., even though the engine is stopped the heat which has accumulated in the engine structure will keep the coolant boiling for a short time. Thus, in order to obviate any chance of super-atmospheric pressures developing, the fan 226 can be operated as long as the thermal requirement of the radiator 210 is high enough.

As the engine cools and the coolant vapor in the cooling circuit condenses the pressure differential between the cooling circuit and the ambient atmosphere displaces coolant from the reservoir 232 into the cooling circuit via purge/transfer conduit 239. As the engine is stopped electromagnetic valve 236 remains closed as no power is available thereto. Accordingly, until either the cooling circuit is completely filled or the pressure differential ceases to exist, coolant will be displaced from the reservoir 232 into the lower tank 222. This fills the circuit in a manner to prevent any of the components of the system being exposed for prolonged periods to the atmospheric air and thus subject to oxidation or the like.

When the engine is restarted after having completely cooled, viz., is subject to a "cold start" with the temperature of the coolant below 50° C. the present invention provides for a quick reduction in the volume of coolant in the coolant jacket 206 and thus promotes very rapid warm-up of the system. Viz., when the engine is started and power is supplied to the circuit including the temperature sensor and electromagnetic valve, if the temperature is below the predetermined level (ie 50° C.) then valve 236 is energized to assume an open state. This permits air to flow into the system via vent conduit 234 and enter the upper tank 220. As there is no valve disposed in purge/transfer conduit 239 and the pump disposed in level control conduit 244 is selected to permit coolant to flow therethrough toward the reservoir 232 when not energized, the coolant contained in the radiator 210, vapor transfer conduit 244, vapor manifold 212 and upper section of the coolant jacket 206 is permitted to be "dropped" (drain) out to reservoir 232 via the purge/transfer conduit 239 and the level control conduit 244 under the influence of gravity. Thus, by arranging the reservoir essentially at or lower than the level illustrated in FIG. 7 it is possible to rapidly reduce the amount of coolant in the coolant jacket 206 to level H. The reduction of coolant volume in the coolant jacket speeds engine warm-up characteristics by reducing the amount of heat which is required to heat the liquid to its boiling point.

In the event that the engine is subject to a re-start before the temperature of the coolant in the coolant jacket drops to 50° C. a hot restart is implemented wherein the coolant "drop" is not carried out and the vapor pressure which naturally develops quickly under such circumstances, permitted to displace the excess coolant out of the system until the coolant level has lowered to level H.

What is claimed is:

1. A cooling system for an engine having a structure subject to a high heat flux, comprising:

a coolant jacket disposed about said structure, said coolant jacket being adapted to receive coolant in liquid form, permit the same to boil and discharge it in gaseous form;

a radiator in fluid communication with said coolant jacket through a connection structure, said radiator being disposed at a level higher than said coolant jacket so that vapor condensed therein can flow under the influence of gravity back to said coolant jacket, said coolant jacket, said radiator and the connection structure fluidly interconnecting the same defining a closed loop cooling circuit;

a device associated with said radiator for varying the amount of heat exchange between said radiator and a cooling medium surrounding the same;

a first temperature sensor disposed in said radiator, said first temperature sensor being operatively connected with said device in a manner to promote the amount of heat exchange between said radiator and said medium in the event that temperature proximate said first temperature sensor reaches or exceeds a first predetermined temperature;

a reservoir which is fluidly discrete from said cooling circuit and in which liquid coolant is stored;

a level control conduit fluidly interconnecting said reservoir and said coolant jacket;

a pump disposed in said level control conduit; and a level sensor disposed in said coolant jacket, said level sensor being arranged to sense the level of liquid coolant falling below a predetermined level which is selected to immerse said structure in a predetermined depth of coolant and define a coolant vapor collection space thereabove, said level sensor being operatively connected with said pump for inducing said pump to induct coolant from said reservoir and pump same into said coolant jacket upon the level of liquid coolant in said coolant jacket falling below said predetermined level.

2. A cooling system as claimed in claim 1, wherein said level control conduit communicates with said coolant jacket through a level control port which is located at or above said predetermined level.

3. A cooling system as claimed in claim 2, further comprising:

a vent conduit which leads from an upper section of said radiator to a source of atmospheric pressure;

a valve disposed in said vent conduit, said valve being arranged to be normally closed and to cut-off communication between said source and said reservoir;

a second temperature sensor disposed in said coolant jacket for sensing the temperature of the liquid coolant therein being at or below a second predetermined temperature, said second temperature sensor being operatively connected with said valve for opening said valve when the engine is running and the temperature of the coolant is at or below said second predetermined level; and wherein said reservoir is located at least in part below said predetermined level.

4. A cooling system as claimed in claim 1, further comprising a purge/transfer conduit, said purge/transfer conduit leading from the downstream end of said radiator to said reservoir, said purge/transfer conduit communicating with said reservoir at a location proximate the lowermost level thereof.

5. A cooling system as claimed in claim 1, wherein said connection structure includes:

a vapor manifold fluidly communicated with a vapor discharge port formed in said coolant jacket;

a vapor transfer conduit leading from said vapor manifold to the upstream end of said radiator; and a condensate return conduit which leads from the downstream end of said radiator to said coolant jacket.

6. A cooling system as claimed in claim 5, further comprising:

a vapor/liquid separator associated with said vapor manifold for separating liquid coolant from the vapor discharge from said coolant jacket through said discharge port, said separator including a drain conduit through which separated liquid coolant is drained back to said coolant jacket.

7. A cooling system as claimed in claim 5, wherein said radiator includes an upper tank at the upstream end thereof, a lower tank at the downstream end thereof and in which said first temperature sensor is disposed, and a core which defines the main heat exchanging surface of the radiator, the core extending between said upper and lower tanks, said radiator being inclined so that condensate formed therein tends to run downhill toward said lower tank.

8. A cooling system as claimed in claim 1, wherein the interior of said reservoir is communicated with the ambient atmosphere through an air bleed.

9. A method of cooling an engine having a structure subject to high heat flux comprising the steps of:

introducing liquid coolant into a coolant jacket disposed about said structure, permitting the liquid coolant to boil and produce coolant vapor;

condensing the coolant vapor in a radiator in fluid communication with said coolant jacket;

using gravity to return the condensate formed in said radiator to said coolant jacket;

storing coolant in a reservoir which is fluidly discrete from said coolant jacket and said radiator;

sensing the level of coolant in said coolant jacket; and pumping coolant from said reservoir into said coolant jacket in response to said step of level sensing indicating that the level of liquid coolant in said coolant jacket is below a predetermined level which is selected to immerse said structure in a predetermined depth of liquid coolant and define a coolant collection space.

10. A method as claimed in claim 9, further comprising the steps of:

sensing the temperature at a preselected location in said radiator;

operating a device associated with said radiator in a manner to promote the heat exchange between said radiator and a cooling medium which surround the same when said temperature sensing step indicates that the temperature is above a first predetermined level.

11. A method as claimed in claim 9, further comprising the step of communicating said reservoir and said coolant jacket via a level control port, said level control port being formed in said coolant jacket at or above said predetermined level to prevent coolant in said coolant jacket below said predetermined level from backflowing toward said reservoir when the coolant is not being pumped into said coolant jacket.

12. A method as claimed in claim 11, further comprising the steps of:

arranging said reservoir so as to be at least in part below said predetermined level;

communicating an upper section of the radiator with a source of atmospheric pressure through a vent conduit;

controlling fluid communication between the radiator and the source using a normally closed valve;

sensing the temperature in said coolant jacket;

opening said valve when the engine is running and the temperature in said coolant jacket is at or below a second predetermined temperature to permit any liquid coolant which is in the radiator and coolant jacket above said predetermined level drain back to said reservoir via said level control port.

13. A method as claimed in claim 9, further comprising the steps of:

communicating the downstream end of said radiator with said reservoir at a location proximate the bottom thereof via a purge/transfer conduit; and displacing non-condensible matter out of said coolant jacket and radiator through said purge/transfer conduit using the vapor generated in said coolant jacket.

14. A method as claimed in claim 9, further comprising the step of maintaining the interior of said reservoir at atmospheric pressure.

* * * * *